US012618127B2

(12) United States Patent
Li et al.

(10) Patent No.: US 12,618,127 B2
(45) Date of Patent: May 5, 2026

(54) Fe—Mn—Al—C LIGHTWEIGHT STEEL, PRODUCTION METHOD THEREOF, TERMINAL, STEEL MECHANICAL PART, AND ELECTRONIC DEVICE

(71) Applicants: HUAWEI TECHNOLOGIES CO., LTD., Shenzhen (CN); Shanghai Future High-tech Co., Ltd., Shanghai (CN)

(72) Inventors: Longyu Li, Dongguan (CN); Ming Cai, Dongguan (CN); Mantang Duan, Shanghai (CN); Meiling Zhu, Shanghai (CN); Zhongyong Deng, Shanghai (CN)

(73) Assignees: Huawei Technologies Co., Ltd., Shenzhen (CN); Shanghai Future High-tech Co., Ltd., Shanghai (CN)

( * ) Notice: Subject to any disclaimer, the term of this patent is extended or adjusted under 35 U.S.C. 154(b) by 423 days.

(21) Appl. No.: 18/173,608

(22) Filed: Feb. 23, 2023

(65) Prior Publication Data

US 2023/0220525 A1 Jul. 13, 2023

Related U.S. Application Data

(63) Continuation of application No. PCT/CN2021/090830, filed on Apr. 29, 2021.

(30) Foreign Application Priority Data

Aug. 25, 2020 (CN) ..... 202010865504.5

(51) Int. Cl.
*C22C 33/02* (2006.01)
*B22F 1/10* (2022.01)
(Continued)

(52) U.S. Cl.
CPC ..... *C22C 33/02* (2013.01); *B22F 1/10* (2022.01); *B22F 3/16* (2013.01); *C22C 38/002* (2013.01);
(Continued)

(58) Field of Classification Search
None
See application file for complete search history.

(56) References Cited

FOREIGN PATENT DOCUMENTS

CN 101748323 A 6/2010
CN 104928569 A 9/2015
(Continued)

OTHER PUBLICATIONS

Schweitzer, Philip A. Paint and Coatings. CRC Press, Sep. 23, 2005, pp. 309-317. (Year: 2005).*
(Continued)

*Primary Examiner* — Anthony M Liang
(74) *Attorney, Agent, or Firm* — Leydig, Voit & Mayer, Ltd.

(57) ABSTRACT

This application provides Fe—Mn—Al—C lightweight steel, including: Fe, wherein a weight percentage of the Fe is greater than or equal to 50.4 wt %; Mn, wherein a weight percentage of the Mn is 25-35 wt %; Al, wherein a weight percentage of the Al is 6-12 wt %; C, wherein a weight percentage of the C is 0.8-2.0 wt %; and O, wherein a weight percentage of the O is 0.005-0.6 wt %. This application further provides a terminal to which the Fe—Mn—Al—C lightweight steel is applied, a production method for the Fe—Mn—Al—C lightweight steel, a steel mechanical part, and an electronic device. The lightweight steel in this application has low density, high strength, and high elongation.

20 Claims, 1 Drawing Sheet

(51) Int. Cl.

| | |
|---|---|
| ***B22F 3/16*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/56*** | (2006.01) |
| ***C22C 38/58*** | (2006.01) |
| *B22F 3/24* | (2006.01) |

(52) U.S. Cl.

CPC ..... *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/56* (2013.01); *C22C 38/58* (2013.01); *B22F 2003/248* (2013.01); *B22F 2301/35* (2013.01); *B22F 2304/10* (2013.01); *B22F 2998/10* (2013.01); *B22F 2999/00* (2013.01)

(56) References Cited

FOREIGN PATENT DOCUMENTS

| | | | |
|---|---|---|---|
| CN | 105624536 | B | 3/2018 |
| CN | 110066904 | A | 7/2019 |
| CN | 110218948 | A | 9/2019 |
| CN | 111041355 | A | 4/2020 |
| CN | 111408724 | A | 7/2020 |

OTHER PUBLICATIONS

Tjong et al., "Laser surface melting of an austenitic Fe-26Mn-7A1-0.9C alloy," Surface and Coatings Technology, Elsevier, NL, vol. 57, No. 2-3, Accepted in final form Nov. 20, 1992, XP024460901, Total 6 pages (May 1993).

* cited by examiner

Fe—Mn—Al—C LIGHTWEIGHT STEEL, PRODUCTION METHOD THEREOF, TERMINAL, STEEL MECHANICAL PART, AND ELECTRONIC DEVICE

CROSS-REFERENCE TO RELATED APPLICATIONS

This application is a continuation of International Application No. PCT/CN2021/090830, filed on Apr. 29, 2021, which claims priority to Chinese Patent Application No. 202010865504.5, filed on Aug. 25, 2020. The disclosures of the aforementioned applications are hereby incorporated by reference in their entireties.

TECHNICAL FIELD

Embodiments of this application relate to Fe—Mn—Al—C lightweight steel, a production method thereof, a terminal to which the Fe—Mn—Al—C lightweight steel is applied, a steel mechanical part, and an electronic device.

BACKGROUND

A rotating shaft mechanism of an existing foldable mobile phone basically includes two materials. One material is a precipitation hardened steel material. The material has good comprehensive mechanical performance, high strength, good toughness, yield strength of approximately 1000 MPa, and elongation of approximately 6%, but density is high, and is approximately 7.8 g/cm$^3$. The other material is an aluminum alloy material with low density of approximately 2.7 g/cm$^3$, but strength is low. For a 7000-series aluminum alloy with highest strength that is commercially available at present, for example, 7075, yield strength is approximately 500 MPa, and the aluminum alloy is prone to deformation during use.

SUMMARY

A first aspect of embodiments of this application provides Fe—Mn—Al—C lightweight steel, including:

Fe, where a weight percentage of the Fe is greater than or equal to 50.4 wt %;

Mn, where a weight percentage of the Mn is 25-35 wt %;

Al, where a weight percentage of the Al is 6-12 wt %;

C, where a weight percentage of the C is 0.8-2.0 wt %; and

O, where a weight percentage of the O is 0.005-0.6 wt %.

The Al element reduces density of the lightweight steel, so that the lightweight steel achieves a lightweight effect. The C element forms a carbide strengthening phase to improve strength of the lightweight steel. The O element forms a strengthening phase. The Fe—Mn—Al—C lightweight steel in this application is a material with high strength, high elongation, and low density.

In an implementation of this application, the lightweight steel further includes Si, Ni, and Cr, a weight percentage of the Si is ≤0.2 wt %, a weight percentage of the Ni is ≤0.6 wt %, and a weight percentage of the Cr is ≤0.4 wt %.

The Si is used to improve activity of the C, and promote dissolution of the C element in a precipitate during aging. The Cr improves corrosion resistance of a steel material to some extent. The Ni helps refine grains and is enriched at a second-phase interface.

In an implementation of this application, the lightweight steel further includes at least one of Cu, V, Ti, Nb, W, Zr, Mo, and Re, and a total weight percentage of Cu, V, Ti, Nb, W, Zr, Mo, and Re is ≤1 wt %.

The lightweight steel further includes at least one of Cu, V, Ti, Nb, W, Zr, Mo, and Re, so that performance of the lightweight steel can be further improved. For example, the Cu may be used as a dispersed phase in the lightweight steel.

In an implementation of this application, the lightweight steel is formed by using a powder raw material and a metal injection molding process.

The metal injection molding process may be used to produce small and complex precision curve lightweight steel parts for being widely used in various electronic products.

In an implementation of this application, the powder raw material includes the following chemical components: 28 wt %≤Mn≤35 wt %, 6 wt %≤Al≤12 wt %, 0.7 wt %≤C≤1.8 wt %, 0.003 wt %≤O≤0.4 wt %, 0≤Si≤0.2 wt %, 0≤Ni≤0.6 wt %, 0≤Cr≤0.4 wt %, and 0≤Cu+V+Ti+Nb+W+Zr+Mo+Re≤1 wt %, and the rest is Fe. Cu+V+Ti+Nb+W+Zr+Mo+Re means that at least one of Cu, V, Ti, Nb, W, Zr, Mo, and Re is included and indicates a total weight percentage of Cu, V, Ti, Nb, W, Zr, Mo, and Re.

The powder raw material may be used to obtain the Fe—Mn—Al—C lightweight steel with a component ratio in this application, and the Fe—Mn—Al—C lightweight steel has high strength, high elongation, and low density.

In an implementation of this application, density of the lightweight steel is 5.9-7.0 g/cm$^3$, yield strength of the lightweight steel is 800-1200 MPa, and elongation of the lightweight steel is 2% to 20%.

The lightweight steel has low density, high strength, and high elongation. The strength of the steel is high. Therefore, reliability of a steel mechanical part using the lightweight steel is ensured without increasing a thickness of the steel mechanical part, to facilitate miniaturization of the steel mechanical part and miniaturization of an electronic device.

In an implementation of this application, a functional coating is formed on a surface of the lightweight steel.

The functional coating further beautifies the lightweight steel as a decorative layer, or further protects the lightweight steel or make the lightweight steel functional as a functional coating.

A second aspect of embodiments of this application provides a terminal, including the Fe—Mn—Al—C lightweight steel.

The Fe—Mn—Al—C lightweight steel has low density/a light weight, high strength, and high elongation, and can be produced by using a metal injection molding process suitable for small and complex precision curve parts, so that performance and/or a service life of the terminal can be effectively improved.

In an implementation of this application, the terminal is a consumer electronics sample, and includes structural parts, and at least one of the structural parts includes the Fe—Mn—Al—C lightweight steel.

The Fe—Mn—Al—C lightweight steel has low density, high strength, and high elongation, to reduce a risk of breakage and deformation of the structural part in the terminal, so that quality of the terminal is improved. The low density is helpful for lightening a terminal product.

In an implementation of this application, the terminal is a foldable mobile phone including a rotating shaft, and the rotating shaft includes the Fe—Mn—Al—C lightweight steel.

The rotating shaft includes the Fe—Mn—Al—C lightweight steel, to reduce a risk that the rotating shaft of the foldable mobile phone falls off to break, and reduce a risk that deformation occurs during use of the rotating shaft, so that quality of the foldable mobile phone is improved.

A third aspect of embodiments of this application provides a production method for Fe—Mn—Al—C lightweight steel, including:

producing a powder raw material, where the powder raw material includes the following chemical components: 28 wt %≤Mn≤35 wt %, 6 wt %≤Al≤12 wt %, 0.7 wt %≤C≤1.8 wt %, 0.003 wt %≤O≤0.4 wt %, 0≤Si≤0.2 wt %, 0≤Ni≤0.6 wt %, 0≤Cr≤0.4 wt %, and 0≤Cu+V+Ti+Nb+W+Zr+Mo+Re≤1 wt %, and the rest is Fe, where Cu+V+Ti+Nb+W+Zr+Mo+Re means that at least one of Cu, V, Ti, Nb, W, Zr, Mo, and Re is included and indicates a total weight percentage of Cu, V, Ti, Nb, W, Zr, Mo, and Re; and producing the Fe—Mn—Al—C lightweight steel by using the powder raw material and a metal injection molding process.

The powder raw material and the metal injection molding process may be used to obtain the Fe—Mn—Al—C lightweight steel with a component ratio in this application, and the Fe—Mn—Al—C lightweight steel has high strength, high elongation, and low density. The Fe—Mn—Al—C lightweight steel is not prone to deformation or breakage under high strength.

In an implementation of this application, the metal injection molding process includes:

forming a green body based on the powder raw material;

sintering the green body to form a sintered body; and performing heat treatment on the sintered body.

The lightweight steel molded by using the metal injection molding process provided in this application can effectively obtain a three-dimensional complex precision steel mechanical part at a time. Compared with a complex precision steel mechanical part molded through conventional mechanical processing, for example, computer numerical control, the steel mechanical part does not need to be additionally processed, so that production efficiency of a complex precision steel material is improved, production costs of the steel material are reduced, and mass production of the steel material is facilitated.

In an implementation of this application, the forming a green body based on the powder raw material includes: mixing the powder raw material with a binder; and molding a mixture of the powder raw material and the binder into the green body through injection molding.

The green body of the lightweight steel is formed through injection molding, so that molding efficiency is high, costs are low, and a green body of three-dimensional complex precision lightweight steel can be effectively obtained at a time, thereby improving production efficiency of the complex precision lightweight steel. The powder raw material is mixed with the binder, and the powder raw material has specific fluidity, so that defects such as cracking or corner breakage of the green body are reduced or avoided. In addition, the powder raw material is mixed with the binder, and the molded green body has specific strength, and can maintain a shape when being removed from a mold cavity, so that deformation of the green body is reduced or avoided, thereby increasing a yield rate.

In an implementation of this application, before the sintering the green body, the production method further includes: degreasing the green body to remove a part of binder in the green body.

In some embodiments, the binder in the green body is removed through catalytic degreasing. Removing the binder through catalytic degreasing takes an advantage of a characteristic that a polymer can be rapidly degraded in a specific atmosphere, so that the green body is degreased in a corresponding atmosphere, and the binder is decomposed to remove the binder. In this embodiment of this application, the binder in the green body is removed through catalytic degreasing, so that rapid and flawless degreasing can be implemented, and degreasing efficiency can be improved, thereby improving steel material production efficiency.

In an implementation of this application, the performing heat treatment on the sintered body includes: performing solution treatment on the sintered body; and aging the sintered body obtained after the solution treatment.

The heat treatment can further improve performance of the lightweight steel.

A fourth aspect of embodiments of this application provides a steel mechanical part. The steel mechanical part is molded by using the foregoing production method.

The steel mechanical part is produced by using the foregoing method, so that the steel mechanical part has low density, high strength, and high elongation. The steel mechanical part is difficult to break and deform, and has a long service life.

A fifth aspect of embodiments of this application provides a steel mechanical part. A material used by the steel mechanical part includes the foregoing Fe—Mn—Al—C lightweight steel The material used by the steel mechanical part includes the Fe—Mn—Al—C lightweight steel, so that strength of the steel mechanical part is improved. Therefore, reliability of the steel mechanical part is further ensured without increasing a thickness of the steel mechanical part, to facilitate miniaturization of the steel mechanical part.

A sixth aspect of embodiments of this application provides an electronic device, including the foregoing steel mechanical part.

The steel mechanical part is applied to the electronic device, so that a risk that the steel mechanical part in the electronic device falls off and breaks and deforms during use is reduced, thereby improving quality of the electronic device. In addition, strength of the steel mechanical part is high. Therefore, reliability of the steel mechanical part is ensured without increasing a thickness of the steel mechanical part, to facilitate miniaturization of the electronic device. In addition, the steel mechanical part has a light weight, so that miniaturization of the electronic device is facilitated.

DESCRIPTIONS OF REFERENCE NUMERALS OF MAIN ELEMENTS

| | |
|---|---|
| Terminal | 100 |
| First part | 110 |
| Second part | 130 |
| Rotating shaft | 20 |

DESCRIPTION OF EMBODIMENTS

The following describes embodiments of this application with reference to the accompanying drawings in embodiments of this application.

Structural parts of a consumer electronics product are usually small precision parts, have complex three-dimensional curved-surface structure, and are required for smooth operation and structural reliability of a mechanism. Therefore, there are multi-dimensional requirements for a material. In addition to requirements for a light weight/low density, at least strength (for example, yield strength and tensile strength), plastic toughness (for example, elongation), molding processes (casting, forging, stamping, computer numerical control (CNC), and the like) are included. Dimensions constrain each other.

A terminal in embodiments of this application includes Fe—Mn—Al—C lightweight steel. The terminal is a consumer electronics product, and includes structural parts, and at least one of the structural part includes the Fe—Mn—Al—C lightweight steel. The Fe—Mn—Al—C lightweight steel has advantages of low density/a light weight, high strength, and being capable of being produced by using a metal injection molding process. The metal injection molding process is suitable for production of small and complex precision curve parts due to a molding characteristic of the metal injection molding process.

Figure 1:
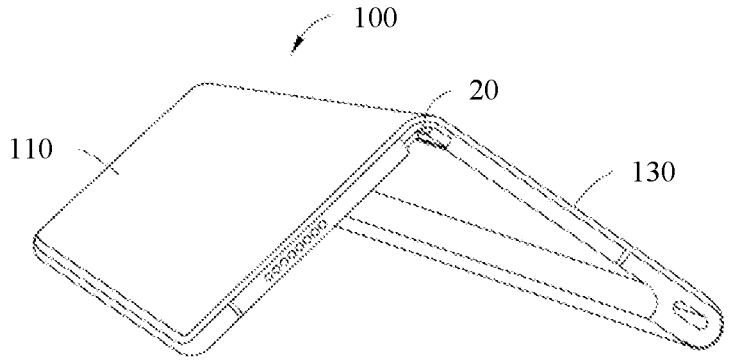
FIG. 1 is a schematic diagram of a structure of a terminal according to an embodiment of this application.

For example, as shown in FIG. 1, a terminal 100 is a foldable mobile phone, including a first part 110 and a second part 130 that are collapsible and a rotating shaft 20 disposed between the first part 110 and the second part 130. The first part 110 and the second part 130 rotate relative to each other by using the rotating shaft 20. A material of the rotating shaft 20 is Fe—Mn—Al—C lightweight steel. It may be understood that the Fe—Mn—Al—C lightweight steel is not limited to forming the rotating shaft of the foldable mobile phone, and may be alternatively a camera decorating part of the mobile phone or another type of structural part in the mobile phone. The Fe—Mn—Al—C lightweight steel may also be used to form a structural part in another consumer electronics product. It may be understood that the Fe—Mn—Al—C lightweight steel may be further applied to a vehicle as an in-vehicle mechanical part.

The Fe—Mn—Al—C lightweight steel in this embodiment of this application includes the following chemical components (the following range values include end values):

Fe, where a weight percentage of the Fe is greater than or equal to 50.4 wt %;

Mn whose weight percentage is 25-35 wt %;

Al whose weight percentage is 6-12 wt %;

C whose weight percentage is 0.8-2.0 wt %; and

O whose weight percentage is 0.005-0.6 wt %.

The lightweight steel further optionally includes Si, Ni, and Cr, a weight percentage of the Si is ≤0.2 wt %, a weight percentage of the Ni is ≤0.6 wt %, and a weight percentage of the Cr is ≤0.4 wt %.

The lightweight steel further optionally includes at least one of Cu, V, Ti, Nb, W, Zr, Mo, and Re, and a total weight percentage of Cu, V, Ti, Nb, W, Zr, Mo, and Re is ≤1 wt %.

It may be understood that the lightweight steel may further include another inevitable impurity element, but the another inevitable impurity element has extremely low content and may be ignored.

The lightweight steel has low density of 5.9-7.0 g/cm$^3$. Compared with density 7.98 g/cm$^3$ of a conventional steel material, a weight of the lightweight steel is reduced by approximately 25% to 14%. Therefore, a weight of a consumer electronics product such as a mobile phone can be greatly reduced, so that user experience is improved. In addition, the lightweight steel has high strength and yield strength of 800-1200 MPa. Plastic toughness is high, and elongation reaches 2% to 20%.

Figure 2:
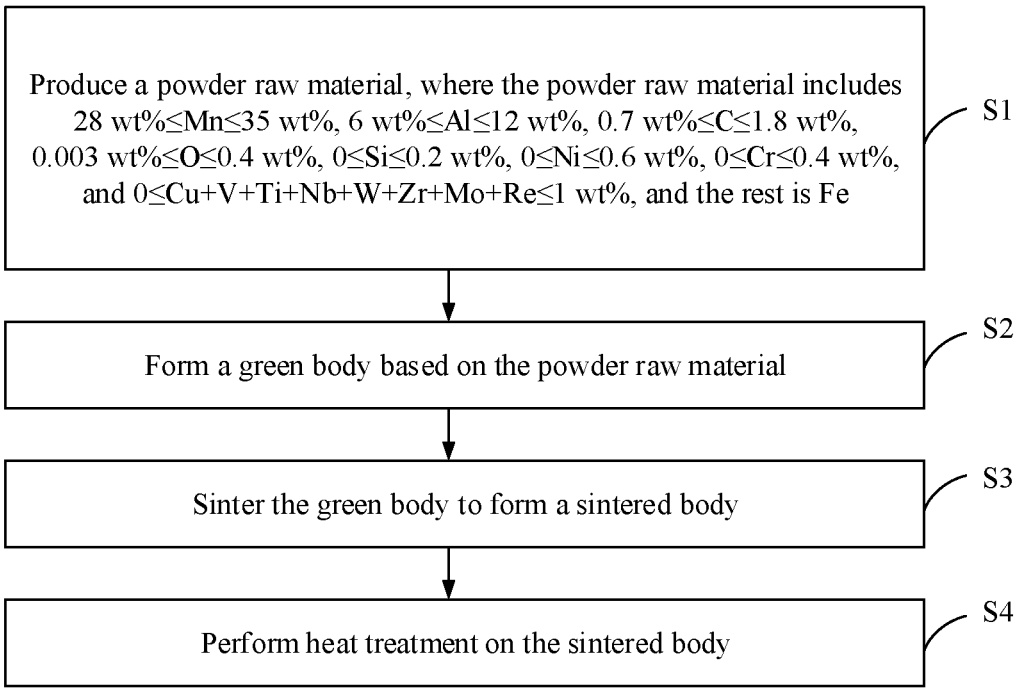
FIG. 2 is a schematic flowchart of a production method for Fe—Mn—Al—C lightweight steel according to an embodiment of this application.

The Fe—Mn—Al—C lightweight steel may be formed by using a powder raw material and a metal injection molding process. As shown in FIG. 2, a production method for the Fe—Mn—Al—C lightweight steel specifically includes the following steps.

S1: Produce a powder raw material, where the powder raw material includes the following chemical components:

28 wt %≤Mn≤35 wt %, 6 wt %≤Al≤12 wt %, 0.7 wt %≤C≤1.8 wt %, 0.003 wt %≤O≤0.4 wt %, 0≤Si≤0.2 wt %, 0≤Ni≤0.6 wt %, 0≤Cr≤0.4 wt %, and 0≤Cu+V+Ti+Nb+W+Zr+Mo+Re≤1 wt %, and the rest is Fe, where Cu+V+Ti+Nb+W+Zr+Mo+Re means that at least one of Cu, V, Ti, Nb, W, Zr, Mo, and Re is included and indicates a total weight percentage of Cu, V, Ti, Nb, W, Zr, Mo, and Re.

S2: Form a green body based on the powder raw material.

S3: Sinter the green body to form a sintered body.

S4: Perform heat treatment on the sintered body.

The forming a green body based on the powder raw material includes: mixing the powder raw material with a binder; and molding a mixture of the powder raw material and the binder into the green body through injection molding (into a mold cavity).

Before the sintering the green body, the production method further includes: degreasing the green body to remove a part of binder in the green body.

The performing heat treatment on the sintered body includes: performing solution treatment on the sintered body; and aging the sintered body obtained after the solution treatment.

The degreasing refers to a process of removing, by using a method such as catalyzing, heating, or dissolving before the sintering processing, most organic binders in the green body formed through injection molding.

The binder is an alloy powder-specific binder, and is usually an organic binder. The binder is used to bind the powder raw material into a whole for ease of subsequent injection molding.

The sintering refers to a process of converting a powdered material (the powder raw material described in this application) into a dense body and enabling, through heating, molecules or atoms in a solid to obtain sufficient energy to migrate, so that particles are bonded on the powder body, thereby generating strength and causing densification and recrystallization. For example, the sintering in this embodiment of this application may be performing heating to 1200° C. to 1300° C. and preserving the heat for 0.5 h to 3 h. During sintering, the binder is removed.

The solution treatment refers to a heat treatment process in which an alloy (a product sintered in this application) is heated to a high-temperature single-phase region and is kept at a constant temperature, so that an excess phase is fully dissolved in a solid solution and then quickly cooled to obtain a supersaturated solid solution. A purpose of the solution treatment is to dissolve a carbide, a y' phase, and the like in a matrix to obtain a uniform supersaturated solid solution, so that uniformly distributed fine strengthening phases such as the carbide and the y' phase are precipitated again during aging. In addition, stress caused by cooling and heating processing is eliminated, so that the alloy is recrystallized. For example, the solution treatment in this embodiment of this application may be performed for 0.5-4 h at a temperature of 980° C. to 1150° C.

The aging refers to a heat treatment process in which a product obtained after the solution treatment in this application is placed at a high temperature or a room temperature to maintain a shape and a size of the product and to change performance with time. For example, the aging in this embodiment of this application may be performed for 0.5-36 h at a temperature of 450° C. to 600° C.

In this embodiment of this application, the powder raw material may be produced by using an atomization method, a reduction method, a mechanical polishing method, or the like. A particle diameter distribution range of the powder raw material, a binder system and ratio, a degreasing manner, and the like use a conventional manner in the art, and may be adjusted accordingly as required.

The chemical components and a ratio of the powder raw material are controlled, and the metal injection molding process is used to obtain components and performance of the Fe—Mn—Al—C lightweight steel disclosed in this application. In addition, a specific process parameter of the metal injection molding process is selected and adjusted, so that it is possible that density of the lightweight steel is further reduced and strength and plastic toughness are improved.

In this embodiment of this application, the powder raw material includes the following chemical components:

28 wt %≤Mn≤35 wt %, 6 wt %≤Al≤12 wt %, 0.7 wt %≤C≤1.8 wt %, 0.003 wt %≤O≤0.4 wt %, 0≤Si≤0.2 wt %, 0≤Ni≤0.6 wt %, 0≤Cr≤0.4 wt %, and 0≤Cu+V+Ti+Nb+W+Zr+Mo+Re≤1 wt %, and the rest is Fe. Cu+V+Ti+Nb+W+Zr+Mo+Re means that at least one of Cu, V, Ti, Nb, W, Zr, Mo, and Re is included and indicates a total weight percentage of Cu, V, Ti, Nb, W, Zr, Mo, and Re.

The powder raw material may be usually produced by using two methods. In one method, pre-alloying is performed to obtain powder, and all elements exist in an alloy form. In the other method, a plurality of simple-substance elements or compounds are still obtained by mixing a plurality of simple-substance elements or compounds based on an adjusted proportion. In this embodiment of this application, oxygen (O) may exist in a form of iron oxide, aluminum oxide, chromium oxide, or the like, or microscopically, oxygen atoms exist in gaps of metal atoms (for example, Fe).

The C element in the powder raw material forms a carbide strengthening phase to improve strength of the steel material. The Cu may be used as a dispersed phase. The Cr improves corrosion resistance to some extent. The O forms strengthening, and may be adjusted during sintering. The Si is used to improve activity of the C, and promote dissolution of the C element in a precipitate during aging. The Ni helps refine grains. As studied, the Ni is enriched at a second-phase interface.

A main crystal structure of the lightweight steel is austenite, and main strengthening phases include a strengthening phase of an intermetallic compound type, for example, FeMn, FeAl, or $Fe_3Al$ and a carbide strengthening phase such as $MC_3$, $M_7C_3$, or $M_{23}C_6$ (where M represents a metal element). An oxide strengthening phase is creatively introduced to components of the lightweight steel in this embodiment of this application, and is mainly a strengthening phase formed by oxygen and aluminum. In a conventional melting steel material, oxygen is an impurity element and needs to be controlled.

A functional coating may be formed on a surface of the Fe—Mn—Al—C lightweight steel as required. The coating may be formed by using a process such as passivation, electroplating, spraying, or physical vapor deposition (PVD).

An embodiment of this application further provides a steel mechanical part (not shown in the figure). The steel mechanical part is molded by using the foregoing production method. The steel mechanical part is produced by using the foregoing method, so that the steel mechanical part has low density, high strength, and high elongation. The steel mechanical part is difficult to break and deform, and has a long service life.

An embodiment of this application further provides a steel mechanical part (not shown in the figure). A material used by the steel mechanical part includes the foregoing Fe—Mn—Al—C lightweight steel. The material used by the steel mechanical part includes the Fe—Mn—Al—C lightweight steel, so that strength of the steel mechanical part is improved. Therefore, reliability of the steel mechanical part is further ensured without increasing a thickness of the steel mechanical part, to facilitate miniaturization of the steel mechanical part.

An embodiment of this application further provides an electronic device (not shown in the figure). The electronic device includes the foregoing steel mechanical part. The steel mechanical part is applied to the electronic device, so that a risk that the steel mechanical part in the electronic device falls off and breaks and deforms during use is reduced, thereby improving quality of the electronic device. In addition, strength of the steel mechanical part is high. Therefore, reliability of the steel mechanical part is ensured without increasing a thickness of the steel mechanical part, to facilitate miniaturization of the electronic device. In addition, the steel mechanical part has a light weight, so that miniaturization of the electronic device is facilitated.

The following further describes the production method for the Fe—Mn—Al—C lightweight steel in embodiments of this application by using a specific embodiment.

Step 1: Produce alloy powder by using an atomization method. A particle diameter D50 of the powder is 5-15 μm (a particle diameter of 50% of particles is 5-15 μm), and D90 is ≤45 μm (a particle diameter of 90% of the particles is ≤45 μm). A total of seven groups of different alloy powder raw materials are produced. For chemical components of the powder, refer to powder embodiments 1 to 7 in Table 1. A weight percentage of Fe is not listed in Table 1, and the weight percentage of Fe is obtained by subtracting a weight percentage of all other elements from 1 in each powder component.

Step 2: Fully mix the seven groups of powder with a binder at a volume ratio of 56:44 at 180° C. to produce seven feeders. A weight ratio of components of the used binder, namely, polyformaldehyde (POM), ethylene-vinyl acetate (EVA), polyethylene (PE), ceresin wax (CW), and stearic acid (SA) is 85:1:5.5:2:1.

Step 3: Place the seven groups of feeders in an injection molding machine, and separately inject the seven groups of feeders into a mold cavity to mold seven groups of green bodies; and use a catalytic degreasing process for the molded green bodies at a temperature of 130° C., to remove a part of binder in the green bodies. A catalyst is fuming nitric acid.

Step 4: Sequentially perform high-temperature sintering of 2 h to 3 h, solution treatment of 1 h, and aging of 2 h on each group of green bodies to obtain at least one sample (lightweight steel). For a specific sintering temperature, solution treatment temperature, and aging temperature corresponding to each sample (lightweight steel), refer to Table 2. For example, a sample 1-1 is obtained through sintering by performing heating to 1200° C.±5° C. and preserving heat for 2 h to 3 h, solution treatment of 1 h at a temperature of 1100° C.±5° C., and aging of 2 h at a temperature of 500° C.±5° C.

For details of chemical components of the samples (lightweight steel), refer to Table 1. Sintering, solution treatment, and aging are performed on each group of powder raw materials in the first to the sixth groups to finally obtain three to five samples (lightweight steel) whose chemical components are different, and differences in chemical components are mainly caused by differences in process parameters of sintering, solution treatment, and aging. The seventh group of powder raw materials corresponds to one sample (lightweight steel).

TABLE 1

| wt % | Mn | Al | C | Si | O | Ni | Cr | Cu | V | Nb | W | Zr | Mo | Re |
|---|---|---|---|---|---|---|---|---|---|---|---|---|---|---|
| Powder embodiment 1 | 28 | 6.7 | 0.8 | 0.13 | 0.018 | 0.03 | 0.35 | 0.05 | 0.04 | 0.2 | 0.01 | 0.1 | \ | \ |
| Sample 1-1 | 25.2 | 6.2 | 0.8 | 0.14 | 0.006 | 0.03 | 0.35 | 0.05 | 0.04 | 0.12 | 0.008 | 0.006 | \ | \ |
| Sample 1-2 | 26.7 | 6.7 | 1.2 | 0.18 | 0.01 | 0.43 | 0.2 | 0.04 | 0.04 | 0.14 | 0.008 | 0.11 | \ | \ |
| Sample 1-3 | 27.7 | 6.7 | 1.4 | 0.17 | 0.38 | 0.55 | 0.21 | 0.01 | 0.02 | 0.2 | 0.01 | 0.08 | \ | \ |
| Powder embodiment 2 | 34.8 | 7.6 | 1.6 | 0.14 | 0.038 | 0.002 | 0.25 | 0.04 | 0.02 | 0.4 | \ | \ | \ | 0.03 |
| Sample 2-1 | 34.5 | 7.1 | 1.4 | 0.14 | 0.01 | 0.002 | 0.28 | 0.04 | 0.02 | 0.26 | \ | \ | \ | 0.01 |
| Sample 2-2 | 32.7 | 7.5 | 1.9 | 0.13 | 0.26 | 0.002 | 0.24 | 0.043 | 0.004 | 0.33 | \ | \ | \ | 0.02 |
| Sample 2-3 | 29.3 | 7.7 | 1.4 | 0.11 | 0.26 | 0.004 | 0.27 | 0.043 | 0.02 | 0.42 | \ | \ | \ | 0.02 |
| Powder embodiment 3 | 29.7 | 8.7 | 0.8 | 0.03 | 0.38 | 0.58 | 0.16 | 0.02 | 0.004 | \ | \ | 0.1 | 0.12 | \ |
| Sample 3-1 | 29.1 | 8.3 | 0.8 | 0.03 | 0.26 | 0.51 | 0.16 | 0.02 | 0.01 | \ | \ | 0.008 | 0.08 | \ |
| Sample 3-2 | 27.5 | 8.5 | 0.8 | 0.02 | 0.36 | 0.55 | 0.08 | 0.03 | 0.045 | \ | \ | 0.02 | 0.11 | \ |
| Sample 3-3 | 28.7 | 8.7 | 1.2 | 0.03 | 0.56 | 0.49 | 0.35 | 0.006 | 0.04 | \ | \ | 0.08 | 0.10 | \ |
| Powder embodiment 4 | 32.3 | 9.1 | 0.9 | 0.083 | 0.21 | 0.008 | 0.32 | 0.01 | 0.013 | 0.26 | \ | \ | \ | \ |
| Sample 4-1 | 30 | 9 | 0.9 | 0.06 | 0.21 | 0.008 | 0.32 | 0.01 | 0.04 | 0.33 | \ | \ | \ | \ |
| Sample 4-2 | 31.7 | 9.1 | 1.1 | 0.08 | 0.36 | 0.003 | 0.18 | 0.004 | 0.014 | 0.23 | \ | \ | \ | \ |
| Sample 4-3 | 26.1 | 9.2 | 1.1 | 0.07 | 0.32 | 0.003 | 0.13 | 0.02 | 0.006 | 0.22 | \ | \ | \ | \ |
| Sample 4-4 | 28.9 | 9.2 | 0.9 | 0.08 | 0.34 | 0.005 | 0.28 | 0.03 | 0.038 | 0.18 | \ | \ | \ | \ |
| Powder embodiment 5 | 32.2 | 10.5 | 1.1 | 0.032 | 0.22 | 0.27 | 0.07 | 0.006 | 0.026 | \ | \ | \ | \ | 0.03 |
| Sample 5-1 | 29.5 | 9.9 | 1.2 | 0.012 | 0.36 | 0.24 | 0.08 | 0.004 | 0.01 | \ | \ | \ | \ | 0.02 |
| Sample 5-2 | 33.7 | 9.9 | 1.2 | 0.036 | 0.12 | 0.32 | 0.03 | 0.01 | 0.04 | \ | \ | \ | \ | 0.04 |
| Sample 5-3 | 31.5 | 10.4 | 1.3 | 0.033 | 0.12 | 0.23 | 0.008 | 0.03 | 0.04 | \ | \ | \ | \ | 0.01 |
| Sample 5-4 | 30.5 | 10.2 | 0.9 | 0.028 | 0.11 | 0.24 | 0.06 | 0.006 | 0.02 | \ | \ | \ | \ | 0.04 |
| Sample 5-5 | 31.9 | 10.1 | 1.4 | 0.03 | 0.26 | 0.3 | 0.02 | 0.03 | 0.04 | \ | \ | \ | \ | 0.008 |
| Powder embodiment 6 | 34 | 11.8 | 1.8 | 0.002 | 0.009 | 0.37 | 0.02 | 0.01 | 0.023 | \ | \ | 0.07 | \ | \ |
| Sample 6-1 | 26.5 | 11.9 | 1.8 | 0.004 | 0.01 | 0.36 | 0.023 | 0.01 | 0.004 | \ | \ | 0.06 | \ | \ |
| Sample 6-2 | 33.4 | 12 | 1.7 | 0.002 | 0.28 | 0.25 | 0.002 | 0.037 | 0.02 | \ | \ | 0.008 | \ | \ |
| Sample 6-3 | 30.6 | 11.2 | 1.4 | 0.003 | 0.006 | 0.31 | 0.03 | 0.05 | 0.01 | \ | \ | 0.05 | \ | \ |
| Sample 6-4 | 31.7 | 11.5 | 1.9 | 0.003 | 0.32 | 0.42 | 0.016 | 0.01 | 0.05 | \ | \ | 0.03 | \ | \ |
| Powder embodiment 7 | 30 | 7.7 | 0.72 | 0.13 | 0.22 | 0.55 | 0.12 | \ | \ | \ | \ | \ | \ | \ |
| Sample 7-1 | 30 | 7.2 | 0.77 | 0.12 | 0.21 | 0.51 | 0.1 | \ | \ | \ | \ | \ | \ | \ |

Performance, including density, yield strength, and elongation, of all obtained samples (lightweight steel) is detected. For details of test results of the samples (lightweight steel), refer to Table 2. For example, density of the sample 1-1 is 6.96 g/cm$^3$, yield strength of the sample 1-1 is 881 MPa, and elongation of the sample 1-1 is 12%.

TABLE 2

| Embodiment | Sintering ° C. | Solution treatment ° C. | Aging ° C. | Density g/cm$^3$ | Yield strength MPa | Elongation % |
|---|---|---|---|---|---|---|
| Sample 1-1 | 1200 | 1100 | 500 | 6.96 | 881 | 12 |
| Sample 1-2 | 1280 | 1150 | 550 | 6.8 | 959 | 10 |
| Sample 1-3 | 1300 | 1080 | 550 | 6.82 | 930 | 10 |
| Sample 2-1 | 1250 | 1050 | 450 | 6.72 | 1023 | 3 |
| Sample 2-2 | 1200 | 1100 | 600 | 6.83 | 1118 | 2 |
| Sample 2-3 | 1280 | 1120 | 520 | 6.55 | 964 | 6 |
| Sample 3-1 | 1300 | 1120 | 500 | 6.38 | 820 | 6 |
| Sample 3-2 | 1250 | 1120 | 550 | 6.43 | 936 | 7 |
| Sample 3-3 | 1200 | 980 | 500 | 6.48 | 961 | 5 |
| Sample 4-1 | 1280 | 1080 | 550 | 6.34 | 1045 | 9 |
| Sample 4-2 | 1300 | 980 | 550 | 6.38 | 1063 | 10 |
| Sample 4-3 | 1250 | 1080 | 550 | 6.37 | 815 | 16 |
| Sample 4-4 | 1280 | 1080 | 550 | 6.42 | 846 | 18 |
| Sample 5-1 | 1280 | 1060 | 550 | 6.27 | 972 | 14 |
| Sample 5-2 | 1300 | 1060 | 550 | 6.25 | 1115 | 6 |
| Sample 5-3 | 1250 | 1060 | 480 | 6.12 | 1176 | 6 |
| Sample 5-4 | 1250 | 1070 | 480 | 6.21 | 1090 | 15 |
| Sample 5-5 | 1280 | 1070 | 480 | 6.11 | 1187 | 4 |
| Sample 6-1 | 1300 | 1000 | 480 | 6.02 | 976 | 3 |
| Sample 6-2 | 1250 | 1100 | 450 | 6.02 | 1100 | 2 |
| Sample 6-3 | 1250 | 1120 | 490 | 6.11 | 860 | 3 |
| Sample 6-4 | 1250 | 1100 | 490 | 5.98 | 950 | 2 |
| Sample 7-1 | 1250 | 1080 | 560 | 6.57 | 970 | 8 |

As can be learned from the above, lightweight steel whose density is 5.9-7.0 g/cm$^3$, yield strength is 800-1200 MPa, and elongation is 2% to 20% can be obtained through powder sintering and subsequent heat treatment manners of solution treatment and aging. This is mainly attributed to sintering molding and introduction of an oxide strengthening phase that are brought by allocation of material components.

It should be noted that the foregoing descriptions are merely specific implementations of this application, but are not intended to limit the protection scope of this application. Any change or replacement readily figured out by a person skilled in the art within the technical scope disclosed in this application shall fall within the protection scope of this application. The implementations of this application and features in the implementations may be mutually combined without conflicting. Therefore, the protection scope of this application shall be subject to the protection scope of the claims.

What is claimed is:

1. An Fe—Mn—Al—C steel, comprising:

Fe, wherein a weight percentage of the Fe is greater than or equal to 50.4 wt %;

Mn, wherein a weight percentage of the Mn is 25-35 wt %;

Al, wherein a weight percentage of the Al is 6-12 wt %;

C, wherein a weight percentage of the C is 0.8-2.0 wt %; and

O, wherein a weight percentage of the O is 0.11-0.6 wt %.

2. The Fe—Mn—Al—C steel according to claim 1, wherein the Fe—Mn—Al—C steel further comprises Si, Ni, and Cr, a weight percentage of the Si is ≤0.2 wt %, a weight percentage of the Ni is ≤0.6 wt %, and a weight percentage of the Cr is ≤0.4 wt %.

3. The Fe—Mn—Al—C steel according to claim 1, wherein the Fe—Mn—Al—C steel further comprises at least one of Cu, V, Ti, Nb, W, Zr, Mo, and Re, and a total weight percentage of Cu, V, Ti, Nb, W, Zr, Mo, and Re is ≤1 wt %.

4. The Fe—Mn—Al—C steel according to claim 1, wherein the Fe—Mn—Al—C steel is formed by using a powder raw material and a metal injection molding process.

5. The Fe—Mn—Al—C steel according to claim 4, wherein the powder raw material comprises the following chemical components:

28 wt %≤Mn≤35 wt %, 6 wt %≤Al≤12 wt %, 0.7 wt %≤C≤1.8 wt %, 0.003 wt %≤0≤0.4 wt %, 0≤Si≤0.2 wt %, 0≤Ni≤0.6 wt %, 0≤Cr≤0.4 wt %, and 0≤Cu+V+Ti+Nb+W+Zr+Mo+Re≤1 wt %, and the rest is Fe, wherein Cu+V+Ti+Nb+W+Zr+Mo+Re means that at least one of Cu, V, Ti, Nb, W, Zr, Mo, and Re is comprised and indicates a total weight percentage of Cu, V, Ti, Nb, W, Zr, Mo, and Re.

6. The Fe—Mn—Al—C steel according to claim 1, wherein density of the Fe—Mn—Al—C steel is 5.9-7.0 g/cm$^3$, yield strength of the Fe—Mn—Al—C steel is 800-1200 MPa, and elongation of the Fe—Mn—Al—C steel is 2% to 20%.

7. The Fe—Mn—Al—C steel according to claim 1, wherein a functional coating is formed on a surface of the Fe—Mn—Al—C steel.

8. A terminal, comprising an Fe—Mn—Al—C steel comprising:

Fe, wherein a weight percentage of the Fe is greater than or equal to 50.4 wt %;

Mn, wherein a weight percentage of the Mn is 25-35 wt %;

Al, wherein a weight percentage of the Al is 6-12 wt %;

C, wherein a weight percentage of the C is 0.8-2.0 wt %; and

O, wherein a weight percentage of the O is 0.11-0.6 wt %.

9. The terminal according to claim 8, wherein the Fe—Mn—Al—C steel further comprises Si, Ni, and Cr, a weight percentage of the Si is ≤0.2 wt %, a weight percentage of the Ni is ≤0.6 wt %, and a weight percentage of the Cr is ≤0.4 wt %.

10. The terminal according to claim 8, wherein the Fe—Mn—Al—C steel further comprises at least one of Cu, V, Ti, Nb, W, Zr, Mo, and Re, and a total weight percentage of Cu, V, Ti, Nb, W, Zr, Mo, and Re is ≤1 wt %.

11. The terminal according to claim 8, wherein the Fe—Mn—Al—C steel is formed by using a powder raw material and a metal injection molding process.

12. The terminal according to claim 11, wherein the powder raw material comprises the following chemical components:

28 wt %≤Mn≤35 wt %, 6 wt %≤Al≤12 wt %, 0.7 wt %≤C≤1.8 wt %, 0.003 wt %≤0≤0.4 wt %, 0≤Si≤0.2 wt %, 0≤Ni≤0.6 wt %, 0≤Cr≤0.4 wt %, and 0≤Cu+V+Ti+Nb+W+Zr+Mo+Re≤1 wt %, and the rest is Fe, wherein Cu+V+Ti+Nb+W+Zr+Mo+Re means that at least one of Cu, V, Ti, Nb, W, Zr, Mo, and Re is comprised and indicates a total weight percentage of Cu, V, Ti, Nb, W, Zr, Mo, and Re.

13. The terminal according to claim 8, wherein density of the Fe—Mn—Al—C steel is 5.9-7.0 g/cm$^3$, yield strength of the Fe—Mn—Al—C steel is 800-1200 MPa, and elongation of the Fe—Mn—Al—C steel is 2% to 20%.

14. The terminal according to claim 8, wherein the terminal is a consumer electronics product, and comprises structural parts, and at least one of the structural parts comprises the Fe—Mn—Al—C steel.

15. The terminal according to claim 8, wherein the terminal is a foldable mobile phone comprising a rotating shaft, and the rotating shaft comprises the Fe—Mn—Al—C steel.

16. A production method for the Fe—Mn—Al—C steel of claim 1, comprising:

producing a powder raw material, wherein the powder raw material comprises the following chemical components:

28 wt %≤Mn≤35 wt %, 6 wt %≤Al≤12 wt %, 0.7 wt %≤C≤1.8 wt %, 0.003 wt %≤0≤0.4 wt %, 0≤Si≤0.2 wt %, 0≤Ni≤0.6 wt %, 0≤Cr≤0.4 wt %, and 0≤Cu+V+Ti+Nb+W+Zr+Mo+Re≤1 wt %, and the rest is Fe, wherein Cu+V+Ti+Nb+W+Zr+Mo+Re means that at least one of Cu, V, Ti, Nb, W, Zr, Mo, and Re is comprised and indicates a total weight percentage of Cu, V, Ti, Nb, W, Zr, Mo, and Re; and producing the Fe—Mn—Al—C steel by using the powder raw material and a metal injection molding process.

17. The production method according to claim 16, wherein the metal injection molding process comprises:

forming a green body based on the powder raw material;

sintering the green body to form a sintered body; and performing heat treatment on the sintered body.

18. The production method according to claim 17, wherein the forming the green body based on the powder raw material comprises: mixing the powder raw material with a binder; and molding a mixture of the powder raw material and the binder into the green body through injection molding.

19. The production method according to claim 18, wherein before the sintering the green body, the production method further comprises: degreasing the green body to remove a part of binder in the green body.

20. The production method according to claim 17, wherein the performing the heat treatment on the sintered body comprises: performing solution treatment on the sintered body; and aging the sintered body obtained after the solution treatment.

* * * * *